US005368395A

United States Patent [19]

Crimmins

[11] Patent Number: 5,368,395

[45] Date of Patent: Nov. 29, 1994

[54] FLEXIBLE STORAGE TANK WITH REMOVABLE INNER LINER

[75] Inventor: Robert A. Crimmins, Felton, Del.

[73] Assignee: ILC Dover, Inc., Frederica, Del.

[21] Appl. No.: 45,177

[22] Filed: Apr. 13, 1993

[51] Int. Cl.[5] ..... A65D 33/08

[52] U.S. Cl. ..... 383/107; 383/111; 383/113

[58] Field of Search ..... 383/41, 61, 42, 79, 383/92, 103, 111, 113, 107

[56] References Cited

U.S. PATENT DOCUMENTS

| | | | |
|---|---|---|---|
| 2,507,939 | 5/1950 | Smith . | |
| 3,044,515 | 7/1962 | Eades . | |
| 3,073,367 | 1/1963 | Samara . | |
| 3,322,320 | 5/1967 | Beadle . | |
| 3,485,281 | 12/1969 | Wicks . | |
| 3,960,192 | 6/1976 | Convain . | |
| 4,203,479 | 5/1980 | Mathews . | |
| 4,222,422 | 9/1980 | Lofberg . | |
| 4,597,102 | 6/1986 | Nattrass | 383/113 |
| 4,648,121 | 3/1987 | Lowz | 383/113 |
| 4,710,967 | 12/1987 | Petschner . | |
| 4,874,258 | 10/1989 | Marino . | |
| 4,901,885 | 2/1990 | Boots . | |
| 4,946,291 | 8/1990 | Schnaars | 383/113 |
| 4,992,310 | 2/1991 | Gelb et al. | 383/113 |
| 5,025,925 | 6/1991 | Wiklund . | |
| 5,050,765 | 9/1991 | Roser et al. . | |

*Primary Examiner*—Joseph Man-Fu Moy

*Attorney, Agent, or Firm*—Stevens, Davis, Miller & Mosher

[57] ABSTRACT

A collapsible flexible tank having an outer tank body of dimensionally stable material and an inner liner of which may be readily interchanged by opening up of zippered seams in the outer tank body. There are a plurality of toggle fasteners inside the outer tank for holding the inner liner in place. A fill and drain fitting at the top of the inner liner enables rapid filling and complete emptying of the tank.

25 Claims, 3 Drawing Sheets

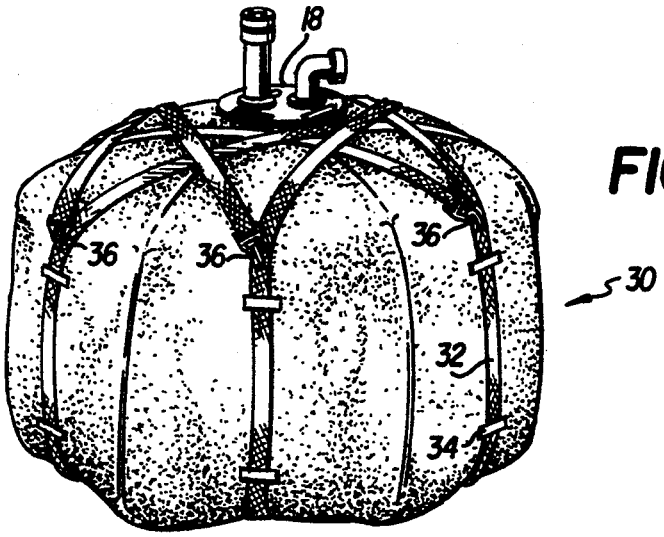
FIG. 1
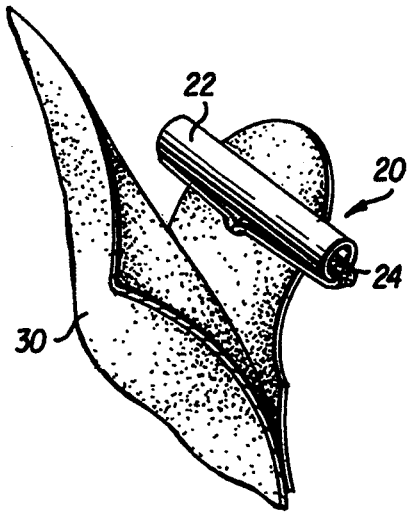
FIG. 3
FIG. 2
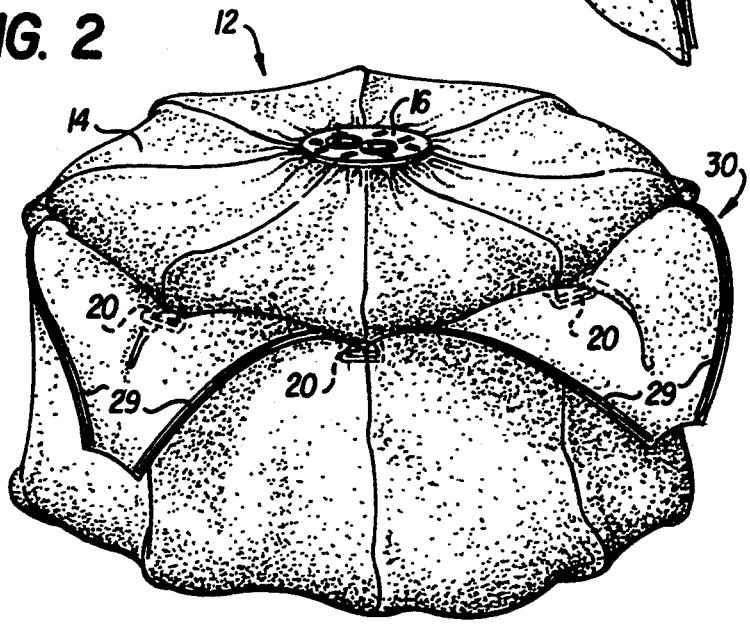

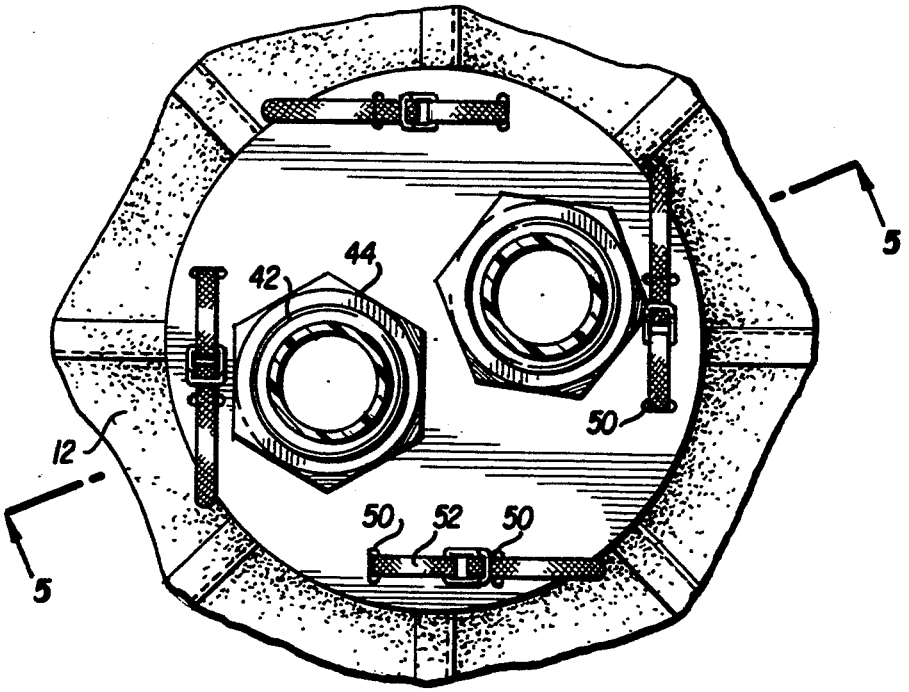
FIG. 4
FIG. 5
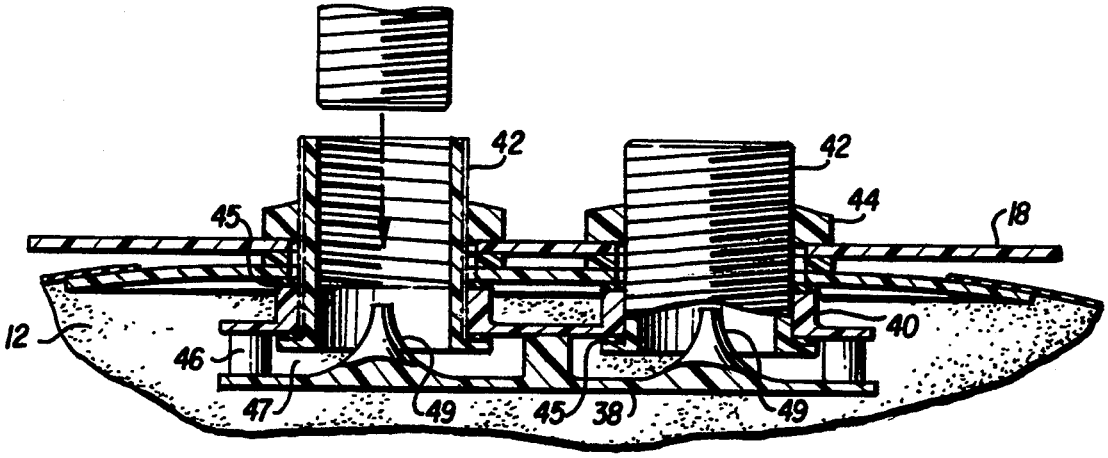

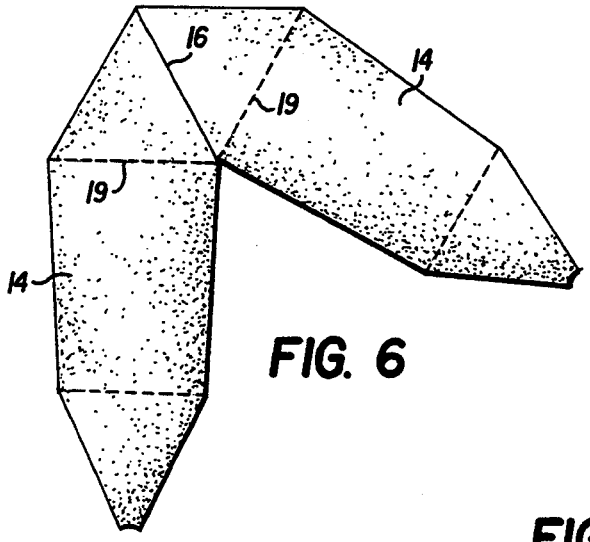
FIG. 6
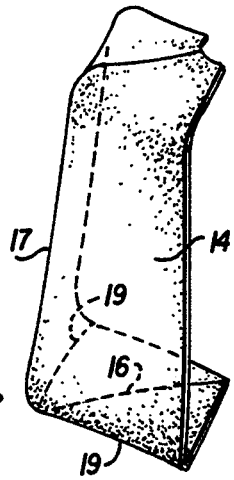
FIG. 7
FIG. 8
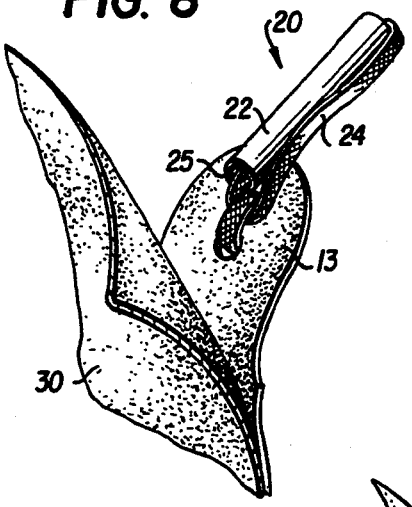
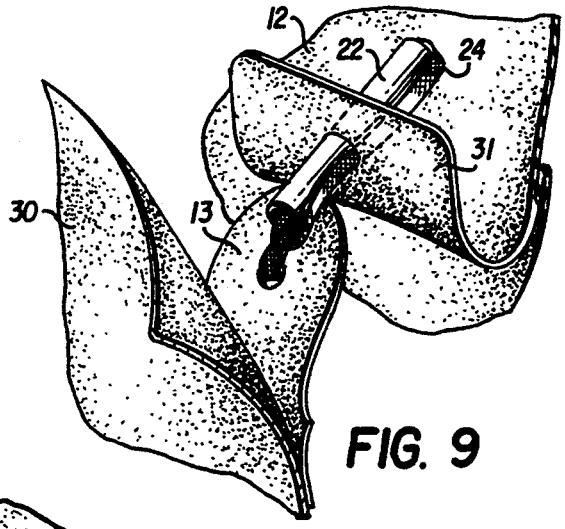
FIG. 9
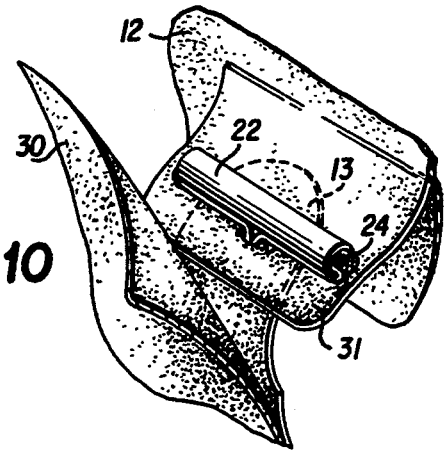
FIG. 10

FLEXIBLE STORAGE TANK WITH REMOVABLE INNER LINER

BACKGROUND OF THE INVENTION

This invention pertains to a flexible storage tank which is made of collapsible flexible material for the storage of liquid or particulate flowable material. It has separate inner and outer tanks, the inner tank or bladder being made of a flexible pliant material which may be individually selected to be impervious and non-reacting to the contents and an outer tank which is made of much stronger material and which acts as a restraint to maintain the inner tank in a desired generally truncated conical shape.

Hereinafter for convenience the inner tank will be referred to as a "liner" and the outer tank will be referred to as a "restraint".

Currently all known collapsible fabric tanks on the market are manufactured from coated fabrics. These fabrics serve as both the restraint means and the fluid retention means. This design works very well for holding fuel or water; however, when used for other chemicals a number of problems arise. First if the chemical is a viscous material such as latex, cleaning of the tank is extremely difficult if not impossible. This means that the tank can only be used for that specific material, and even then the inside surface quickly becomes coated with hardened product which may flake off into the fresh latex. Secondly, the coated materials limit the chemical resistance which can be obtained by such a tank (i.e. most tanks utilize either urethane coated fabrics, or nitrile type rubber coated fabrics). The ability to use films such as Teflon, polyethylene, etc. greatly enhances the ability of the tank to withstand a wide spectrum of chemicals.

In addition, typical collapsible fabric tanks have a small aspect ratio (i.e. they tend to have a large footprint as compared to their height). This may be objectionable if it is being applied in an area which imposes floor space restrictions.

SUMMARY OF THE INVENTION

The invention comprises a collapsible flexible tank for storage of flowable materials having two major components: an inner tank or liner of pliant flexible film material such as sheet polyethylene or a coextruded film of polyethylene and nylon or a polyethylene film having an outer surface with non-woven plastic fibers adhered thereto; an outer tank or restraint made of a heavier and stronger material which is flexible and dimensionally stable such as a four ply stitch bonded fabric of high modulus.

The restraint has a plurality of straps for acting as a lifting harness. The restraint also is made up of a plurality of panels, preferably eight which form a generally octagonal shape at the base and is upstanding to maintain a generally truncated cone shape when viewed from the side. The panels are seamed together and some of the seams, preferably seams in the upper half of the tank have quick connect and disconnect means, such as zippers, to allow easy interchange of the liner.

A fill/drain fitting at the top of the tank is secured to the liner and to a plurality of straps so as to take up any stress on the fitting and to keep the stress off the liner. The fill/drain fitting preferably has two openings, one for the admission or discharge of the filling material and the other for air to be admitted or discharged from the flexible tank as the contents are added or discharged. The liner may be readily interchanged by opening the zippers. The liner is held in place inside the restrain by a plurality of toggle fasteners which are easily disconnected but yet will securely hold the liner in proper position within the restraint.

BRIEF DESCRIPTION OF THE DRAWINGS

FIG. 1 is a perspective view of the flexible tank of the present invention showing it in an expanded condition as if it were filled;

FIG. 2 is a view similar to FIG. 1 but showing the zippers of the outer tank in a retracted position with portions of the outer tank folded back to reveal the inner liner;

FIG. 3 is a perspective view of a toggle fastener used between the liner and the outer tank;

FIG. 4 is a top view of the tank of FIG. 1 showing the fill/drain fitting;

FIG. 5 is a sectional view along line 5—5 of FIG. 4;

FIG. 6 is a plan view showing two of the panels used in assembling the tank;

FIG. 7 is a perspective view to show the manner of seaming together the panels of FIG. 6;

FIG. 8 is a perspective view of the toggle shown in FIG. 3 prior to insertion into a hole in a flap of the liner;

FIG. 9 is a perspective view of the toggle of FIG. 8 being inserted;

FIG. 10 is a perspective view of the toggle of FIG. 9 but viewed from the other side, after insertion and sliding into its secured position.

DETAILED DESCRIPTION OF A PREFERRED EMBODIMENT

Turning now to the drawings in greater detail, FIG. 1 shows the flexible tank of the present invention in its complete assembled position as it would appear when filled with a liquid or particulate flowable solid material. It comprises an outer tank or restraint 30 having a plurality of straps 32 the loose ends of which can be pulled up above the tank to act as a lifting harness, that is the D rings 36 may be joined in a shackle for lifting with a hoist. The straps are held in place on the outer surface of the tank by a plurality of lift harness guides 34. At the top of the tank is a fill/drain fitting 18 which will be disclosed in greater detail in connection with FIGS. 4 and 5.

FIG. 2 shows the tank of FIG. 1 but with the outer restraint opened up to reveal the inner liner 12. It should be noted that FIG. 2 is for the sake of illustration only to show the liner 12 apparently filled with a liquid or particulate solid material but in actual practice one would not open up the outer restraint when the liner is filled.

In any case, FIG. 2 shows that the restraint has a plurality of quick connect and disconnect means such as zippers 29 which can be readily opened to facilitate the replacement of the inner liner 12. That is, there may be a plurality of liners 12 which will fit within a particular restraint 30. These liners can be of different material to be impervious to and non-reactant with various chemicals which may be stored within a liner such as acids, alkalines, foods, medical products, cleaning solutions, oil spills, hazardous wastes, etc. The materials used for the liner may be, for example, polyethylene film, a coextruded film of polyethylene and nylon, a liquid crystalline polymer film or one of these films with an outer layer of non-woven plastic fibers adhered thereto. The latter film has been found to have a particularly good resistance to puncturing from the outside due apparently to the "bridging" of the fibers and the local reinforcement at the point of puncture stress.

The liner may be a large shaped piece of film but it is preferably made up of a plurality of panels which are heat sealed or chemically welded to each other at their seams. The restraint is also preferably made up of a plurality of panels so the following description in conjunction with FIGS. 6 and 7 may be taken as potentially applicable to either the liner 12 or the restraint 30.

It has been found desirable to make the tank in the shape of a truncated cone so that the base is the largest cross section and the cross section becomes gradually smaller toward the top of the tank. The cross section is preferably octagonal but in use, due to the internal pressure of the filling material, it will appear almost circular.

The restraint 30 or the liner 12 is made up preferably of eight panels, each panel having the shape of an elongated hexagon. As shown for the sake of illustration in FIG. 6, the panels 14 may be adhered together along their short sides at an end to form a plurality of short seams 16 with FIG. 6 showing only one of those short seams 16, it being understood that when all eight panels are so joined the assembly would be of a generally circular flower pedal shape.

In actual practice two panels 14 are first joined together along the entire length of their long sides 17. Thus eight panels become four subassemblies which are then joined together to form two halves which are then joined to make a complete restraint.

The short seams 16 (to be at the bottom of the tank or liner) are all formed, by folding each panel along fold line 19 so as to bring short seams 16 into generally horizontal alignment.

The liner is preferably made from eight panels. Each panel has straight sides and they are joined with outside pinch seams. This patterning approach and edge joint allows for "accordion folding" of the panels one on top the other and completion of multiple seams in a single heat seal hit. Liner assembly is much less time consuming than if it were put together one seam at a time.

The process and materials used to form the seams is, of course, dependent upon the material of the panels 14; it may involve chemical solvents, adhesives or heat sealing etc. all of which is known by those skilled in the art of the particular material being used. The same procedure as used for the panels of the liner 12 is used for the panels of the restraint 30 except that with the liner the seams are closed along the top of the liner also, whereas in the case of the restraint 30, the upper portion of at least some of the seams, preferably four of the eight seams, is not permanently sealed together but is instead detachably secured by quick disconnect means such as zippers, buttons, snaps, hook and loop tape such as VELCRO (registered trademark), etc. In forming the seams in the restraint it is undesirable to have any inwardly protruding sharp edge or fold that might protrude into the liner and cause a puncture or a point of high stress. For that reason the restrain seams are preferably flat simple overlap seams. It is contemplated to tape the exterior of the restraint seams to protect the stitching thereof.

The restraint is preferably made from a dimensionally stable fabric, that is, one that will not stretch or deform in any direction even when loaded, such as a four ply or multiple stitch bonded fabric; such a fabric may be described, for example, as a 4 ply fabric with a heavy black urethane film laminated on one side and a light clear urethane coating on the other side. The fabric has the following characteristics:

| | |
|---|---|
| weight | 12.3 oz/yd |
| width | 62 in. |
| denier | 1500 on all four plies |
| count | 12 threads/inch 0, 90 ± 45° |
| stitching thread | 220 denier |

Such a fabric may be obtained from Miliken Inc. of Spartanburg, S.C.

The laminated liner material mentioned above having non-woven fibers adhered to the outer surface thereof has the following technical specification:

film is James River Corp. Zeelon 520 4.0±0.5 mils fibers are Polyester non-woven from Foss Mfg. Co., 3.0±0.5 oz/yd$^2$; and the EVA adhesive (9%) is natural color ultrathene UE 635-000 or equivalent.

It is also contemplated that the liner material could be high density polyethylene with a non-woven reinforcement; vinyl with reinforcement; polytetrafluoro ethylene (Teflon) with reinforcement or liquid crystalline polymer.

Referring now to FIGS. 4 and 5, there is shown the fill/drain fitting 18 having an inner plate 38 and an outer plate 40. At least one filler pipe 42 projects from the outer plate 40. In FIGS. 4 and 5 there is shown two pipes 42, each having standard 2 inch pipe threads on their inner diameter and threads on their outer surfaces to receive two locknuts 44 which, when threaded down on the pipes, grip a specially laminated double portion of the liner to form a fluid tight seal therewith. A new liner comes with the fitting 18 already attached and has gaskets 45 to insure a tight seal.

The inner plate 38 is held spaced from the outer plate 40 by spacers 46 so as to define an open area 47 over which the filling material may evenly spread to achieve more uniform filing of the tank without impinging on any particular area of the inside surface of the liner. The even distribution is further assured by a conically shaped protrusion 49 extending upwardly from inner plate 38 and being centered under each pipe 42.

Since the tank is flexible the fill/drain fitting will rise and fall with the flexing of the tank top, thus maintaining a spacing at or slightly above the liquid level in the tank. When the tank is being drained by suctioning out the contents through one of the pipes 42, the other pipe 42 is capped to prevent air from entering while at the same time inner plate 38 will be in contact with the fluid level so that the entire contents can be pumped out. The inner plate and spacers prevent the liner material from choking off the fluid around the fitting in the final states of discharge.

As can now best be seen in FIG. 4 there are a plurality of rectangular openings 50 through the upper portion of the restraint, through which auxiliary straps 52 may pass and be fastened so that any strain on the fitting 18 is taken up by the restraint 30 rather than by the liner 12 which is less able to handle additional strain.

As shown in FIGS. 3, 8, 9 and 10 the toggle fastener 20 used between the exterior surface of the liner 12 and the interior surface of the restraint 30 comprises a cord 24 such as nylon parachute cord which is tied in a closed loop. An elongated hollow plastic tube 22 has an axial opening 25 through which the cord 24 passes so that the tube 22 may be freely slid along the cord 24. As shown in FIG. 8 the cord is first looped through or secured to a hole in a tab 13 extending inwardly from the restraint 30. The tube 22 is then slid along the cord so that the portion of the cord 24 lying outside the tube 22 is parallel to the longitudinal axis of the tube so as to minimize the diameter of the tube plus the cord.

As shown in FIG. 9, the tube 22 is then slid through a hole in liner seam 31 which protrudes outwardly from the liner 12. After the entire length of the tube 22 is passed through the hole, then the tube 22 is again slid along the length of the cord 24 until the longitudinal axis of the tube is lying generally parallel to the plane of the liner seam 31. At that point it is impossible for the tube to pass back through the hole in the liner seam 31 and the liner 12 is thus securely fastened to the interior of the restraint 30; thus the liner is held in proper position inside the restraint so that as the liner is filled, it will take proper shape within the restraint without wrinkles or stretched area which could cause stress points in the liner.

This toggle fastener finds uses other than in the present tank, for example, in the medical field for securing covering over patients, in securing tarps or canvasses over articles stored outdoors and space exploration where a gloved hand may need to manipulate a fastener.

I claim:

1. A collapsible flexible tank for storage of flowable material comprising an outer tank body made of a plurality of panels of flexible dimensionally stable fabric secured together at a plurality of seams to form a flexible tank of generally conical shape with a maximum diameter at its lower end and of progressively decreasing diameter toward its upper end with an opening at said upper end;

a liner for positioning within said outer tank body of a similar size and shape and made of a pliant sheet impervious to said flowable material, said liner having an opening at its top which aligns with the opening at the top of said outer tank body;

said outer tank body having at least one openable seam adjacent said upper end and quick connect and disconnect means for opening and closing said seam for insertion and removal of said liner;

said outer tank body having an inner surface and said liner having a outer surface which confronts said inner surface when said liner is in position inside said outer tank body and a plurality of connecting means extending between said outer tank body and said liner for detachably securing at a plurality of discrete securing points within said outer tank body;

a fill and drain means attached to the top opening of said liner.

2. The tank of claim 1 wherein liner is made of a pliant sheet of polyethylene.

3. The tank of claim 1 wherein the liner is made of a coextruded film of polyethylene and nylon.

4. The tank of claim 1 wherein the liner is made of a film of polytetrafluoro ethylene.

5. The tank of claim 1 wherein the liner is made of liquid crystalline polymer.

6. The tank of claim 2 wherein the outer surface of said liner has a layer of non-woven plastic fibers adhered thereon.

7. The tank of claim 3 wherein the outer surface of said liner has a layer of non-woven plastic fibers adhered thereon.

8. The tank of claim 4 wherein the outer surface of said liner has a layer of non-woven plastic fibers adhered thereon.

9. The tank of claim 5 wherein the outer surface of said liner has a layer of non-woven plastic fibers adhered thereon.

10. The tank of claim 1 wherein the flexible dimensionally stable fabric of said outer tank is a four ply stitch bonded fabric.

11. The tank of claim 1 wherein the flexible fabric is dimensionally stable as a result of a high modulus film in the fabric construction.

12. The tank of claim 1 wherein the fill and drain means comprises an outer plate having at least one opening and an inner plate held in spaced relationship from said outer plate to define a flow path between said plates.

13. The tank of claim 1 wherein the fill and drain means is secured to the outer tank for strain relief.

14. The tank of claim 1 in which said quick connect and disconnect means on said outer tank body is at least one zipper.

15. The tank of claim 1 in which said means on said inner and outer surfaces for detachably securing said liner is a toggle fastener comprising an elongated tubular body having a diameter and open at both ends with an axially extending passage therethrough, a flexible cord secured to one of said tank body and liner, said cord being in a closed loop and passing freely through said axially extending passage so that said tubular body can be slid along said closed loop, the other of said tank body and liner not having said cord secured thereto having an aperture of a size just large enough to receive said tubular body when it is slid along the cord loop so that substantially the entire portion of the loop outside the tubular body extends parallel to the loop portion inside the body, the arrangement being such that after the tubular body is passed through said aperture, the tubular body can be slid along the loop until there is an approximately equal portion of the loop extending from each end of the tubular body to thus prevent the tubular body from passing back through the aperture.

16. A collapsible flexible tank for storage of flowable material comprising an outer tank body made of a plurality of panels of flexible dimensionally stable fabric, said panels having the shape of an elongated hexagon, said panels being secured together at a plurality of seams to form the outer tank body in a generally conical shape with a generally flat bottom and a maximum diameter at its lower end, said tank having sidewalls defining a progressively decreasing diameter toward an upper end of said outer tank body and an opening at said upper end, said elongated hexagon panels being mutually positioned so that one long end of each panel lies at the base of said outer body with the seams between adjacent panels extending horizontally and radially outwardly from the center of said generally flat bottom, said seams turning vertically upward to run along said sidewall and then turning radially inwardly and extending toward said opening in said upper end, a liner for positioning within said outer tank body and of a similar size and shape and made of a pliant sheet impervious to said flowable material, said liner having an opening at its top for alignment with the opening at the top of said outer tank body, a fill and drain means attached to the top of said liner;

at least some of the seams of said outer tank body being openable and having quick connect and disconnect means for opening and closing thereof for the insertion and removal of said liner.

17. The tank of claim 16 wherein liner is made of a pliant sheet of polyethylene.

18. The tank of claim 16 wherein the liner is made of a coextruded film of polyethylene and nylon.

19. The tank of claim 16 wherein the liner is made of a film of polytetrafluoro ethylene.

20. The tank of claim 16 wherein the liner is made of liquid crystalline polymer.

21. The tank of claim 16 wherein the outer surface of said liner has a layer of non-woven plastic fibers adhered thereon.

22. The tank of claim 16 wherein the flexible dimensionally stable fabric of said outer tank is a four ply stitch bonded fabric.

23. The tank of claim 15 wherein the fill and drain means comprises an outer plate having at least one opening and an inner plate held in spaced relationship from said outer plate to define a flow path between said plates.

24. The tank of claim 16 in which said quick connect and disconnect means on said outer tank body is a zipper.

25. The tank of claim 16 in which said means on said inner and outer surfaces for detachably securing said liner is a toggle fastener comprising an elongated tubular body having a diameter and open at both ends with an axially extending passage therethrough, a flexible cord secured to one of said tank body and liner, said cord being in a closed loop and passing freely through said axially extending passage so that said tubular body can be slid along said closed loop, the other of said tank body and liner not having said cord secured thereto having an aperture of a size just large enough to receive said tubular body when it is slid along the cord loop so that substantially the entire portion of the loop outside the tubular body extends parallel to the loop portion inside the body, the arrangement being such that after the tubular body is passed through said aperture, the tubular body can be slid along the loop until there is an approximately equal portion of the loop extending from each end of the tubular body to thus prevent the tubular body from passing back through the aperture.

* * * * *